US008654011B2

(12) United States Patent
Eom et al.

(10) Patent No.: US 8,654,011 B2
(45) Date of Patent: Feb. 18, 2014

(54) SHAPED-BEAM ANTENNA WITH MULTI-LAYERED METALLIC DISK ARRAY STRUCTURE SURROUNDED BY DIELECTRIC RING

(75) Inventors: Soon-Young Eom, Daejeon (KR); Je-Hoon Yun, Daejeon (KR); Soon-Ik Jeon, Daejeon (KR); Chang-Joo Kim, Daejeon (KR)

(73) Assignee: Electronica and Telecommunications Research Institute, Daejeon (KR)

( * ) Notice: Subject to any disclaimer, the term of this patent is extended or adjusted under 35 U.S.C. 154(b) by 675 days.

(21) Appl. No.: 12/528,733

(22) PCT Filed: Feb. 26, 2008

(86) PCT No.: PCT/KR2008/001101

§ 371 (c)(1),
(2), (4) Date: Aug. 26, 2009

(87) PCT Pub. No.: WO2008/105617

PCT Pub. Date: Sep. 4, 2008

(65) Prior Publication Data

US 2010/0109964 A1 May 6, 2010

(30) Foreign Application Priority Data

Feb. 28, 2007 (KR) ..... 10-2007-0020565

(51) Int. Cl.
*H01Q 5/00* (2006.01)

(52) U.S. Cl.
USPC ..... 343/700 MS

(58) Field of Classification Search
USPC ..... 343/700 MS
See application file for complete search history.

(56) References Cited

U.S. PATENT DOCUMENTS

| | | | | |
|---|---|---|---|---|
| 4,633,262 | A * | 12/1986 | Traut | 343/700 MS |
| 6,157,348 | A * | 12/2000 | Openlander | 343/846 |
| 6,452,565 | B1 | 9/2002 | Kingsley et al. | |
| 7,619,568 | B2 * | 11/2009 | Gillette | 343/700 MS |
| 2005/0275590 | A1 * | 12/2005 | Eom et al. | 343/700 MS |

FOREIGN PATENT DOCUMENTS

| | | | |
|---|---|---|---|
| KR | 1020010039531 | A | 5/2001 |
| KR | 1020030071996 | A | 9/2003 |
| KR | 1020050117316 | A | 12/2005 |

OTHER PUBLICATIONS

Soon-Young Eom, et al; "A Study on the MDAS-DR Antenna for Shaping Flat-Topped Radiation Pattern", Journal of the Korean Institute of Electromagnetic Engineering & Science(domestic). Mar. 2007, vol. 18, No. 3, pp. 323-333.

Soon-Young Eom, et al; "A Study on a Planar Array Antenna Design with a Flat-Topped Radiation Pattern", Copyright © 2004 NuriMedia Co., Ltd, pp. 896-905.

(Continued)

*Primary Examiner* — Hoang V Nguyen
*Assistant Examiner* — Kyana R McCain
(74) *Attorney, Agent, or Firm* — Ladas & Parry LLP

(57) ABSTRACT

Provided is a shaped-beam antenna having a multi-layered conductive element array surrounded by a dielectric ring. The shaped-beam antenna includes: a planar excitation element having a radiation structure according to a required polarization; a multi-layered conductive element array disposed on the planer excitation element, wherein the multi-layered conductive element array is formed by layering conductive elements at an arbitrary interval; and a dielectric ring surrounding the multi-layered conductive element array at a predetermined separation distance therefrom. Accordingly, it is possible to reduce the entire size of the shaped-beam antenna and manufacturing costs thereof.

17 Claims, 10 Drawing Sheets

(56) References Cited

OTHER PUBLICATIONS

Soon-Young Eom, et al; "An Experimental Study on Shaping Flat-Topped Element Patterns of a Multi-layered Disk Array Structure Excited by Cross-Dipole Elements", Journal of the Korean Institute of Electromagnetic Engineering & Science(domestic), Jul. 2003, vol. 14, No. 7, pp. 712-720.

S. Y. Eom, et al; "High Gain Radiating Structure Using Multi-layered Metallic Disks", IEEE antennas and Propagation Society International Symposium, Jun. 20-25, 2004, vol. 2, pp. 1595-1598.

International Search Report: PCT/KR2008/001101.

* cited by examiner

SHAPED-BEAM ANTENNA WITH MULTI-LAYERED METALLIC DISK ARRAY STRUCTURE SURROUNDED BY DIELECTRIC RING

TECHNICAL FIELD

The present invention relates to a shaped-beam antenna generating a flat-topped beam pattern formed with a multi-layered metallic disk array disposed on a planar excitation element and a dielectric ring surrounding the multi-layered metallic disk array structure, and more particularly, to a shaped-beam antenna generating a flat-topped beam pattern by including a finite number of metallic disks layered in a wave propagation direction on a stack microstrip patch excitation element inserted into a cylindrical cavity and a dielectric ring surrounding the layered metallic disks at a predetermined separation distance therefrom.

BACKGROUND ART

In the future, various wireless local area network (WLAN) services are expected to occur. However, the available frequency spectrum resources for supporting WLAN services have decreased. Therefore, in order not to damage signals (that is, to suppress interference) between WLAN services, the frequency spectrum resources and service coverage are expected to be strictly limited.

In order to efficiently provide WLAN services, electromagnetic waves having uniform amplitude should be radiated within a service coverage range, and a side lobe level should be suppressed. An antenna for WLAN services is required to provide a flat-topped beam pattern with a limited field of view (LFOV) characteristic.

A passive multi-terminal-network array structure, a coupled double-mode waveguide array structure, a passive reactive load element array structure, a pseudo optical network array structure, a protruding-dielectric-rod array structure, and a multi-layered disk array structure (MDAS) have been recently proposed as conventional flat-topped beam pattern forming devices.

In comparison with other flat-topped beam pattern structures, the MDAS can generate a desired current distribution by using mutual coupling between radiating elements in a free space, so that highly-efficient, small-sized, light-weighted, inexpensive antenna system can be implemented by using the MDAS.

In an antenna forming a single flat-topped beam pattern, an active MDAS and several passive MDASs surrounding the active MDAS are overlapped through mutual coupling so as to constitute an overlapped sub-array. However, such an antenna isn't efficient to form the flat-topped beam pattern.

Therefore, there is a need for a new shaped-beam antenna structure suitable for an antenna forming a single flat-topped beam pattern.

DISCLOSURE OF INVENTION

Technical Problem

The present invention provides a shaped-beam antenna including a finite number of metallic disks layered in a wave propagation direction at a predetermined interval on a planar excitation element (that is, a stack microstrip patch element inserted into a cylindrical cavity) and a dielectric ring surrounding the layered metallic disks at a predetermined separation distance therefrom, so that a flat-topped beam pattern can be generated.

The shaped-beam antenna is excited by the planar excitation element, and electromagnetic waves are radiated into a free space by the multi-layered metallic disk array structure surrounded by the dielectric ring.

Technical Solution

According to an aspect of the present invention, there is provided a shaped-beam antenna having a multi-layered conductive element array structure surrounded by a dielectric ring, comprising: a planar excitation element having a radiating structure according to a required polarization; a multi-layered conductive element array disposed on the planer excitation element, wherein the multi-layered conductive element array is formed by layering conductive elements at an arbitrary interval; and a dielectric ring surrounding the multi-layered conductive element array at a predetermined separation distance therefrom.

Advantageous Effects

According to the present invention, in a shaped-beam antenna generating a flat-topped beam pattern, since an active MDAS is surrounded by a dielectric ring structure (DRS) instead of passive MDASs of a conventional shaped-beam antenna, it is possible to reduce the entire size (diameter and height) of the antenna and the manufacturing costs thereof.

In addition, in the shaped-beam antenna generating a flat-topped beam pattern, since the active MDAS is continuously surrounded by the dielectric ring structure (DRS) instead of the passive MDASs which discretely surround the active MDAS of the conventional shaped-beam antenna, it is possible to obtain more efficient flat-topped beam pattern characteristic.

DESCRIPTION OF DRAWINGS

The above and other features and advantages of the present invention will become more apparent by describing in detail exemplary embodiments thereof with reference to the attached drawings in which.

BEST MODE

According to an aspect of the present invention, there is provided a shaped-beam antenna having a multi-layered conductive element array structure surrounded by a dielectric ring, comprising: a planar excitation element having a radiating structure according to a required polarization; a multi-layered conductive element array disposed on the planer excitation element, wherein the multi-layered conductive element array is formed by layering conductive elements at an arbitrary interval; and a dielectric ring surrounding the multi-layered conductive element array at a predetermined separation distance therefrom.

The planar excitation element may have a radiating structure including a microstrip patch structure or a dipole structure.

The planar excitation element may include a stack microstrip patch element inserted into a cylindrical cavity.

The stack microstrip patch element may include an active patch element and a passive patch element, wherein the active patch element is constructed by inserting a conductive member into an RF (radio frequency) substrate having an arbitrary diameter and an arbitrary thickness by using a thick-layer forming method, and wherein the passive patch element is constructed by using a thin conductive film or by coating a conductive member on a thin film.

A dielectric foam layer having an arbitrary thickness may be interposed between the active patch element and the passive patch element so as to maintain a predetermined distance between the active patch element and the passive patch element.

In the multi-layered conductive element array, the conductive elements may be layered at a regular or irregular interval in an upward direction separated by a predetermined separation distance from the planar excitation element.

Dielectric foam layers having a thickness corresponding to the regular or irregular interval may be interposed between the conductive elements.

A dielectric constant $\in_r$ of a dielectric material used for the dielectric foam may be 1.05.

The multi-layered conductive element array may be constructed by layering conductive disks.

The interval between the conducive elements and a size of each conductive element may be equal to or smaller than a non-resonance structure characteristic value of $0.5\lambda_0$.

The flat-topped beam pattern may be generated by adjusting design parameters of the dielectric ring.

The design parameter of the dielectric ring may include a dielectric constant of a dielectric material used for the dielectric ring and a radius, a height, and a thickness of the dielectric ring.

Mode for Invention

Hereinafter, exemplary embodiments of the present invention will be described in detail with reference to the accompanying drawings.

Figure 1:
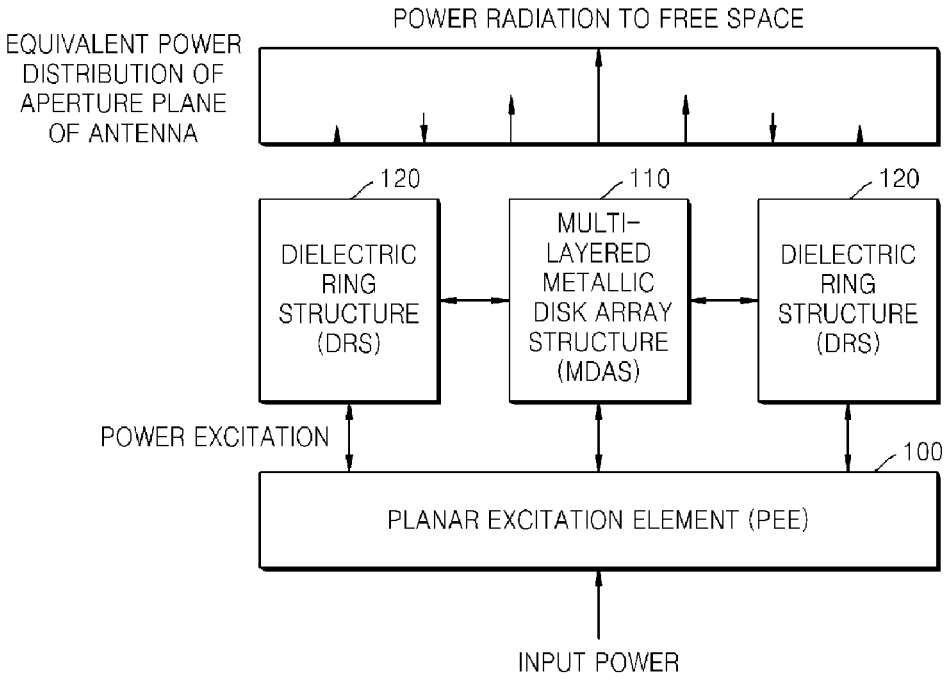
FIG. 1 is a view illustrating a shaped-beam antenna having a flat-topped beam pattern characteristic according to an embodiment of the present invention.

FIG. 1 is a view illustrating a shaped-beam antenna having a flat-topped beam pattern characteristic according to an embodiment of the present invention. Referring to FIG. 1, the shaped-beam antenna includes a planar excitation element 100, a multi-layered metallic disk array 110, and a dielectric ring 120.

When power is input to the planar excitation element 100, the power is excited through the multi-layered metallic disk array 110 constructed by layering a finite number of metallic disks on the planar excitation element 100 and the dielectric ring 120 surrounding the multi-layered metallic disk array 110.

Due to the coupling of the dielectric ring 120 and the multi-layered metallic disk array 110 fed with the power from the planar excitation element 100, a power distribution is formed on an aperture plane of the shaped-beam antenna. The power distribution is effectively used to generate a flat-topped beam pattern.

Figure 2A:
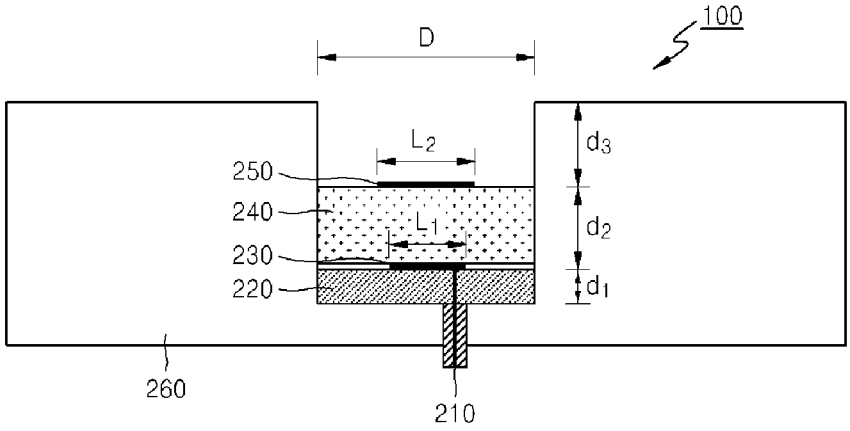
FIGS. 2A to 2C are views illustrating a stack microstrip patch excitation structure inserted into a cylindrical cavity of a planar excitation element according to the an embodiment of the present invention.
Figure 2B:
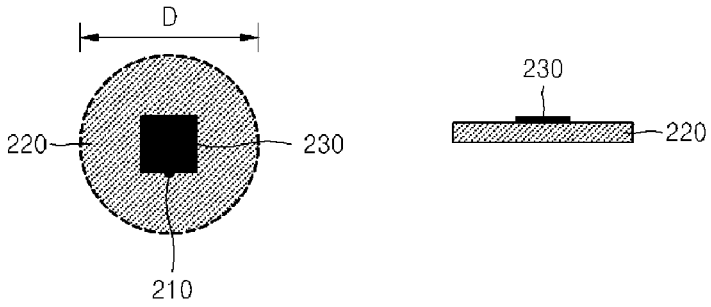
Figure 2C:
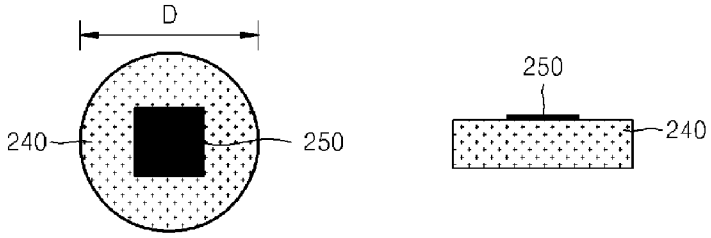

FIGS. 2A to 2C are views illustrating a stack microstrip patch excitation structure inserted into a cylindrical cavity of the planar excitation element according to the embodiment of the present invention.

The planar excitation element 100 having the stack microstrip patch excitation structure inserted into the cylindrical cavity includes an active patch element 230 and a passive patch element 250.

FIG. 2A is a cross-sectional view illustrating the stack microstrip patch excitation structure inserted into the cylindrical cavity.

The active patch element 230 is constructed by inserting a conductive member into a radio frequency (RF) substrate 220 having a diameter D and a thickness d1 by using a thick-layer forming method. The passive patch element 250 is formed by using a thin conductive film or by coating a conductive member on a thin film. The passive patch element 250 is disposed on the active patch element 230 with a dielectric foam layer 240 having a predetermined design-parameter thickness $d_2$ interposed therebetween.

The input power is fed through a coaxial feed cable 210 which passes through a base or a ground structure 260 to be connected to an edge portion of the active patch element 230. The input impedance can be set to 50Ω by adjusting a separation distance between the active patch element 230 and the passive patch element 250, that is, the thickness d2 of the dielectric foam layer 240.

Since an input return loss of the planar excitation element 100 greatly influences the total input return loss of the shaped-beam antenna, the input return loss of the planar excitation element 100 should be properly set.

A design-parameter thickness $d_3$ is a height from the passive patch element 250 to the top of the cylindrical cavity, and a design-parameter D is a diameter of the cylindrical cavity. The design parameters are determined so that electromagnetic waves reflected on the multi-layered metallic disk array 110 can be re-radiated into the free space through electromagnetic-wave matching.

FIG. 2B shows top and cross-sectional views illustrating the active patch element 230 formed on the RF substrate 220 having a diameter D by using a thick-layer forming method and a feed point of the coaxial feed cable 210.

FIG. 2C shows top and cross-sectional views illustrating the passive patch element 250 attached on the dielectric foam layer 240 having a diameter D by using an adhesive.

Design parameters of the stack microstrip patch structure are determined by simulation so that the input impedance and gain characteristics can be optimized. In the present invention, a coaxial feeding scheme in which active and passive patch elements are arrayed in a rectangular structure suitable for linear polarization is provided. However, according to a required polarization, various patch element array structure and feeding schemes may be used.

Figure 3:
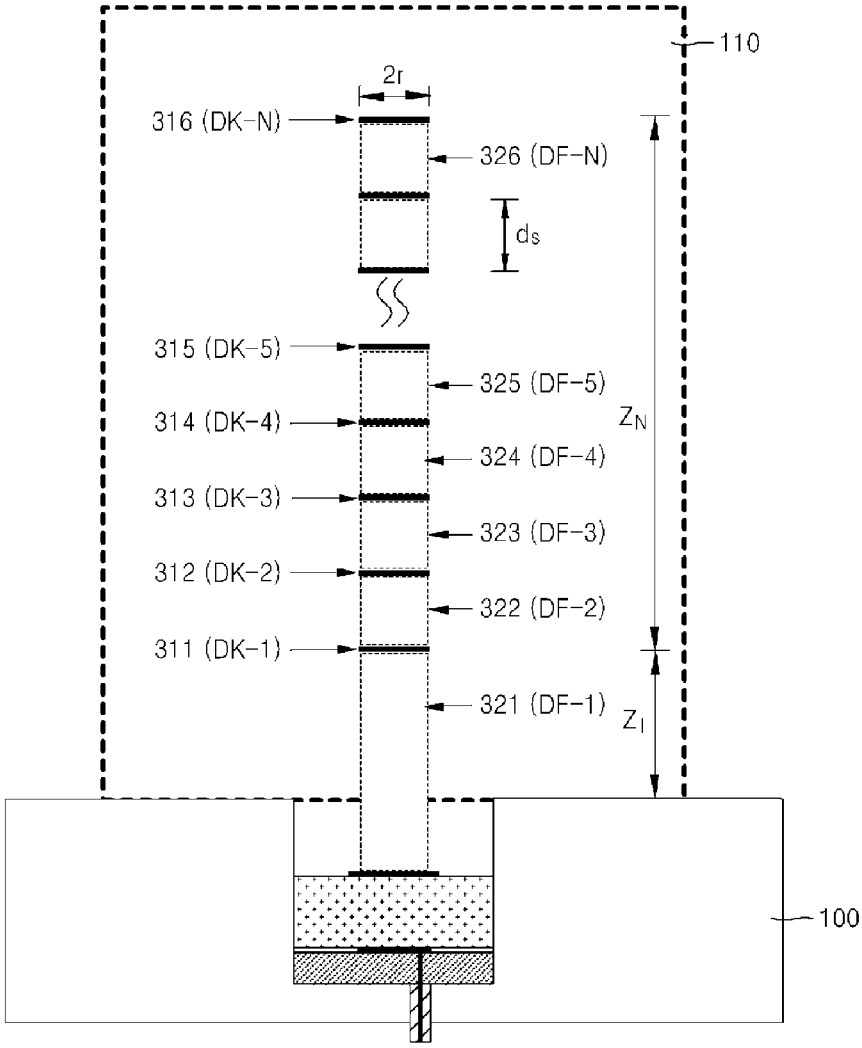
FIG. 3 is a cross-sectional view illustrating a multi-layered metallic disk array structure according to another embodiment of the present invention.

FIG. 3 is a cross-sectional view illustrating a multi-layered metallic disk array structure according to an embodiment of the present invention.

Referring to FIG. 3, the multi-layered element array 110 constructed with a finite number of elements is disposed on a planar excitation element 100 at a predetermined separation distance z1.

In the multi-layered metallic disk array 110, metallic disks are layered at a predetermined interval in a vertical direction of a stack microstrip patch element along a coaxial line so as to constitute a stack metallic disk array.

Namely, the multi-layered metallic disk array 110 includes a first dielectric foam layer 321 formed on the passive patch element 250; a first metallic disk 311 layered on the first dielectric foam layer 321; a second dielectric foam layer 322 layered on the first metallic disk 311; a second metallic disk 323 layered on the second dielectric foam layer 322; . . . ; and an N-th metallic disk 316 layered on the N-th dielectric foam layer 326. In other words, the multi-layered metallic disk array 110 is formed by alternately layering the dielectric foam layers and the metallic disks.

The design parameters for the multi-layered metallic disk array structure are a distance z1 between a bottom of the cylindrical cavity and the first metallic disk, a diameter 2*r* of the metallic disk, an interval ds between the metallic disks, and the number N of the metallic disks.

Particularly, the diameter 2*r* and the interval ds are important design parameters which influence the radiation pattern of an antenna. The diameter 2*r* and the interval ds need to be smaller than $0.5\lambda_0$, which are values for a non-resonance structure.

Preferably, the diameter 2*r* is in range of about $0.25\lambda_0$ to $0.35\lambda_0$, and the interval ds is in a range of about $0.1\lambda_0$ to $0.2\lambda_0$.

As a reference, an antenna having no dielectric ring 120 surrounding the multi-layered metallic disk array 110 exhibits a high-gain characteristic, but not a flat-topped beam pattern characteristic.

In addition, even in case of an antenna having the dielectric ring 120, the antenna may exhibit the flat-topped beam pattern characteristic or the high-gain characteristic according to dielectric constant of the dielectric material. In order to implement a shaped-beam antenna having the flat-topped beam pattern characteristic, the multi-layered metallic disk array 110 and the dielectric ring 120 need to be provided, and an optimal dielectric constant needs to be selected.

In the present invention, it is assumed that the dielectric constant of the dielectric material used for the dielectric foam layers has $\in_r=1.05$, that is, a substantially ideal value thereof. When manufacturing the antenna according to the present invention, the intervals between the metallic disks may not be equal to each other, and the diameters of the metallic disks may be different from each other.

In addition, instead of the metallic disk having a circular shape, metallic elements having other shapes may be used.

Figure 4:
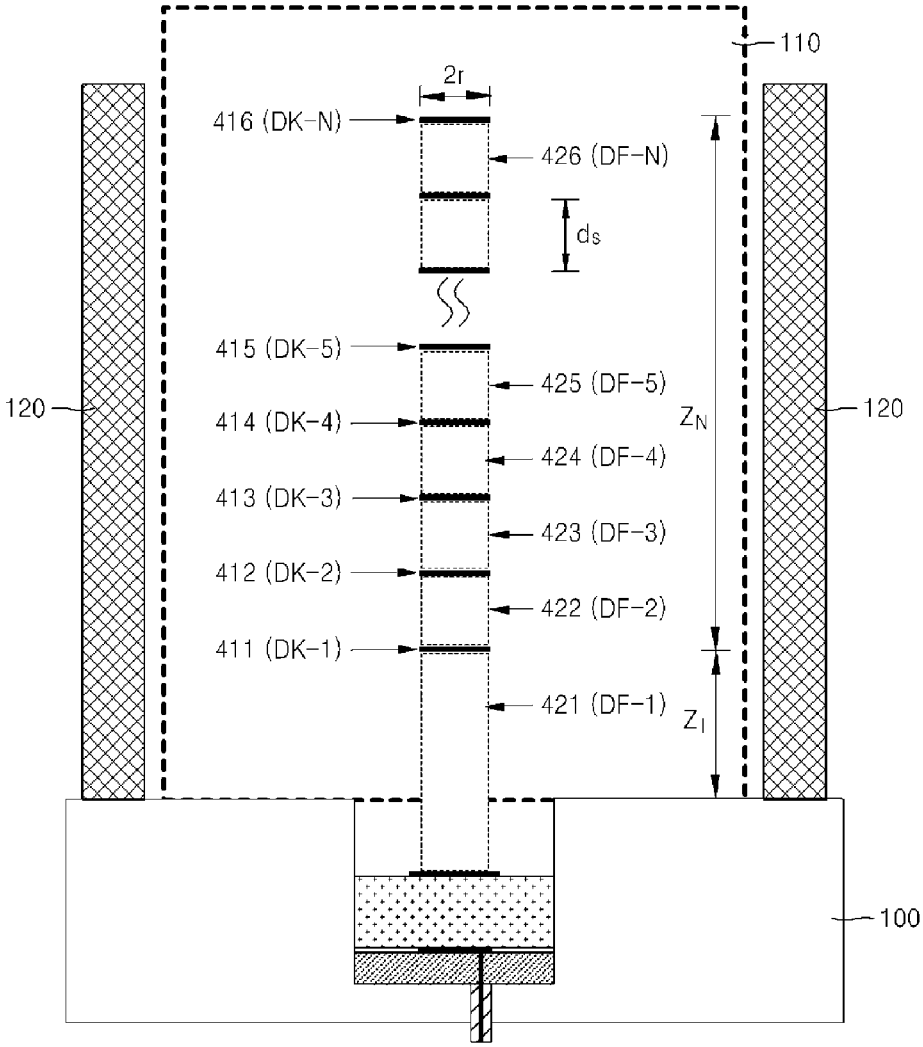
FIG. 4 is a cross-sectional view illustrating a shaped-beam antenna having a flat-topped beam pattern characteristic according to another embodiment of the present invention.

FIG. 4 is a cross-sectional view illustrating a shaped-beam antenna having a flat-topped beam pattern characteristic according to another embodiment of the present invention. Referring to FIG. 4, the shaped-beam antenna according to the embodiment of the present invention includes a planar excitation element 100, a dielectric ring 120, and a multi-layered metallic disk array 110 as shown in FIG. 1.

Figure 5A:
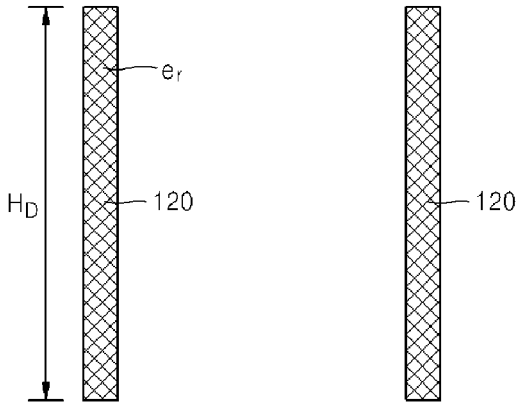
FIGS. 5A and 5B are views illustrating a dielectric ring structure according to an embodiment of the present invention.
Figure 5B:
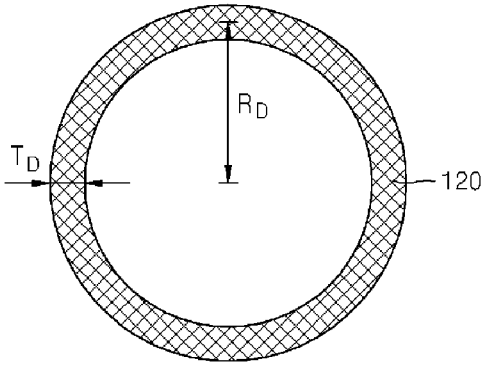

FIGS. 5A and 5B are views illustrating a dielectric ring structure according to an embodiment of the present invention.

FIG. 5A is a cross-sectional side view of the dielectric ring 120 surrounding the multi-layered metallic disk array 110 at a predetermined separation distance, and FIG. 5B is a top view of the dielectric ring 120.

In the shaped-beam antenna according to the present invention, design parameters for the dielectric ring 120 as well as the aforementioned design parameters for the multi-layered metallic disk array 110 influence the flat-topped beam pattern characteristic. The design parameters for the dielectric ring 120 are a dielectric constant $e_r$, a radius $R_D$, a height $H_D$, and a thickness $T_D$. Particularly, the dielectric constant $e_r$ is the most important design parameter which greatly influences the flat-topped beam pattern characteristic.

Figure 6:
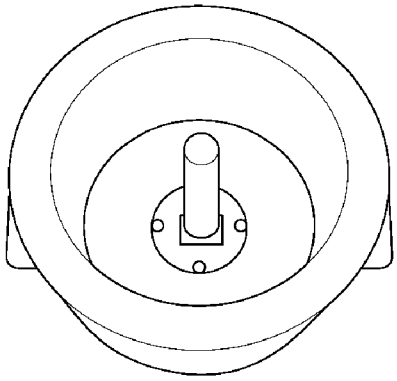
FIG. 6 is a view illustrating a picture of a product sample of a shaped-beam antenna according to an embodiment of the present invention.

FIG. 6 is a view illustrating a picture of a sample of a shaped-beam antenna according to an embodiment of the present invention.

Hereinafter, the design parameters, simulation results, and measurement results of the product of the shaped-beam antenna having the flat-topped beam pattern characteristic in an operating frequency range of 9.6 to 10.4 GHz ($f_0$=10 GHz), according to the embodiment of the present invention will be described.

The simulation is carried out using the commercially available simulator CST Microwave Studio™.

Table 1 shows the design parameters of the stack microstrip patch element inserted into the cylindrical cavity. The value of the design parameters are obtained by simulation. Table 2 shows the design parameters of the multi-layered metallic disk array structure and the dielectric ring structure.

TABLE 1

| Items | Name of Design Parameters | Values of Design Parameters |
|---|---|---|
| active patch element | $L_1$ | 10.05 mm(W) × 10.05 mm(L) |
| passive patch element | $L_2$ | 11.15 mm(W) × 11.15 mm(L) |
| Feeding Position | — | 0.0 mm(@ |

TABLE 1-continued

| Items | Name of Design Parameters | Values of Design Parameters |
|---|---|---|
| | | horizontal offset), 5.075 mm(@ vertical offset) |
| RF Substrate (Active Patch) | — | TLY5A($\epsilon_r$ = 2.17, T = 0.5 oz) |
| | $d_1$ | 0.508 mm |
| Separation Distance between Patches | $d_2$ | 2.66 mm |
| Material between Patches | — | Dielectric Foam |
| Height of Cavity from Passive Patch | $d_3$ | 1 mm |
| Diameter of Cavity | D | 30 mm(1 $\lambda_0$ @ 10 GHz) |

TABLE 2

| Items | | Name of Design Parameters | Values of Design Parameters f = 1.00$f_0$ | f = 10 GHz |
|---|---|---|---|---|
| Multi-layered Metallic Disk Array Structure | Diameter | 2r | 0.3 $\lambda_0$ | 9 mm |
| | Number of Layers | N | 12 | |
| | Initial Position | $z_1$ | 0.3 $\lambda_0$ | 9 mm |
| | Last Position | $z_N$ | 1.4 $\lambda_0$ | 42 mm |
| | Distance between Layers | $d_s$ | 0.1 $\lambda_0$ | 3 mm |
| Dielectric Ring Structure | Dielectric Constant | $\epsilon_r$ | 1.05, 2.05, 3.64 | |
| | Radius | $R_D$ | 1.4~1.6 $\lambda_0$ | 42~48 mm |
| | Height | $H_D$ | 1.0~1.4 $\lambda_0$ | 30~42 mm |
| | Thickness | $T_D$ | 0.03~0.0 $\lambda_0$ | 10 mm |

The excitation element of the shaped-beam antenna having the flat-topped beam pattern characteristic is manufactured by using the RF substrate and the design Parameters listed in Table 1. 12 metallic disks having a diameter of 9 mm and a thickness of 0.1 mm are manufactured by using copper pyrites. The metallic disks are adhered on the dielectric foam layers having a thickness of 3 mm by using an adhesive.

The dielectric ring having a radius of 45 mm and a height of 36 mm is manufactured from Teflon having a dielectric constant of 2.05 according to Table 2.

An input return loss characteristic of the sample of the shaped-beam antenna is measured using a vector network analyzer (VNA). The measurement results of the input return loss characteristic together with simulation results are illustrated in FIG. 7.

Figure 7:
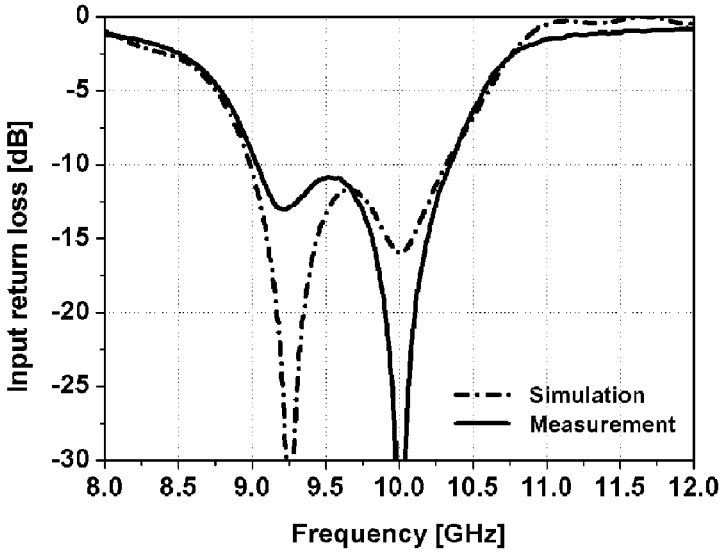
FIG. 7 is a graph illustrating measured and simulated input return loss characteristics of a shaped-beam antenna according to an embodiment of the present invention.

FIG. 7 is a graph illustrating measured and simulated input return loss characteristics of the shaped-beam antenna according to the embodiment of the present invention.

In the measurement results compared with the simulation results, shapes of the curves are slightly different, but two resonance points are located substantially at the same positions. From the measurement results, it can be seen that the input return loss is equal to or greater than 8.6 dB in the operating frequency range of 9.4 to 10.6 GHz.

Referring to the simulation and the measurement results, the central frequency of the input return loss characteristic is about 9.7 GHz. Therefore, the performance of the shaped-beam antenna can be improved by scaling the design parameters down to those corresponding to the central frequency of 10 GHz.

Since the input return loss characteristic of the shaped-beam antenna is greatly influenced by the design parameters of the excitation element, it is more effective to scale down only the design parameters of the excitation element while keeping constant the design parameters of the multi-layered metallic disk array and the dielectric ring.

Figure 8:
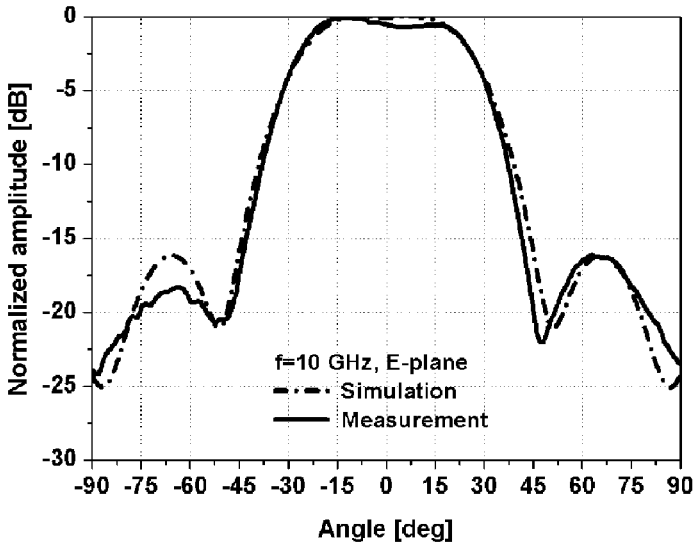
FIG. 8 is a graph illustrating measured and simulated E-plane radiation pattern characteristics of a shaped-beam antenna at a central frequency of 10 GHz according to an embodiment of the present invention.
Figure 9:
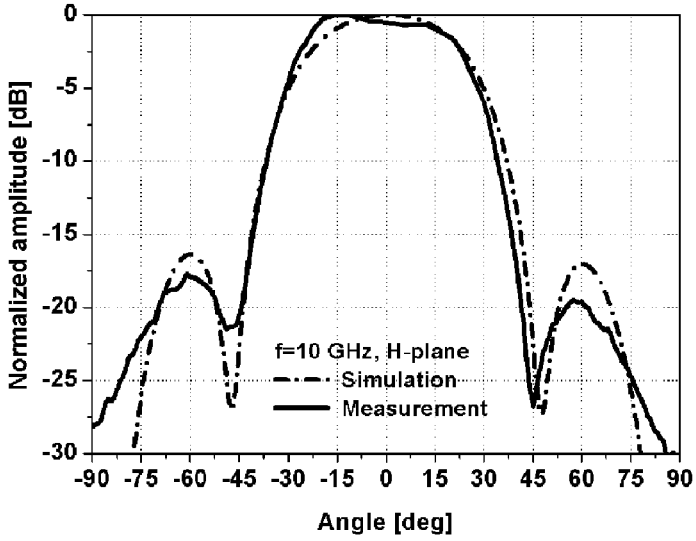
FIG. 9 is a graph illustrating measured and simulated H-plane radiation pattern characteristics of the shaped-beam antenna at the central frequency of 10 GHz according to the embodiment of the present invention.

Measurement results and simulation results of the flat-topped beam radiation pattern of the sample of the shaped-beam antenna at a central frequency of 10 GHz are illustrated in FIGS. 8 and 9.

FIG. 8 is a graph illustrating the measured and simulated E-plane radiation pattern characteristics of the shaped-beam antenna at the central frequency of 10 GHz according to the embodiment of the present invention.

FIG. 9 is a graph illustrating the measured and simulated H-plane radiation pattern characteristics of the shaped-beam antenna at the central frequency of 10 GHz according to the embodiment of the present invention;

Referring to FIGS. 8 and 9, the measurement results and the simulation results are relatively identical to each other. The simulated and measured radiation patterns are normalized with a maximum gain of the antenna.

Particularly, the measured radiation pattern has a maximum gain of 11.18 dBi in the direction angle of 12°. The 1 dB flat-topped beam pattern width is measured as about 43° in E-plane and 38° in H-plan.

Figure 10:
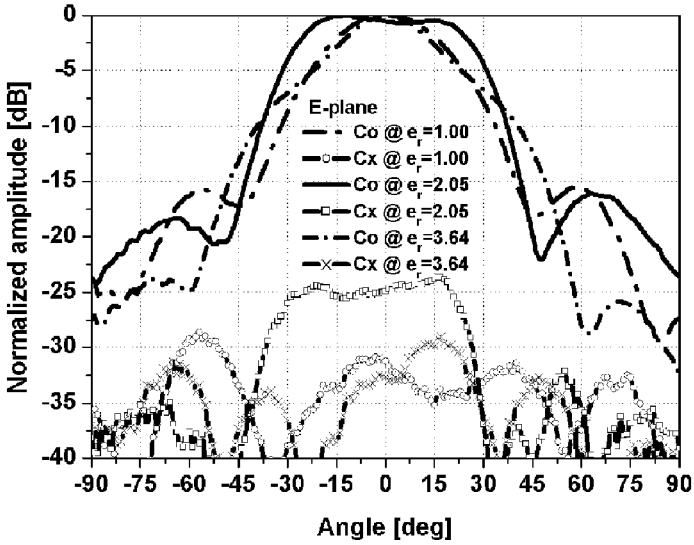
FIG. 10 is a graph illustrating an E-plane radiation pattern characteristic measured ac cording to a change in dielectric constant of a shaped-beam antenna according to an embodiment of the present invention.
Figure 11:
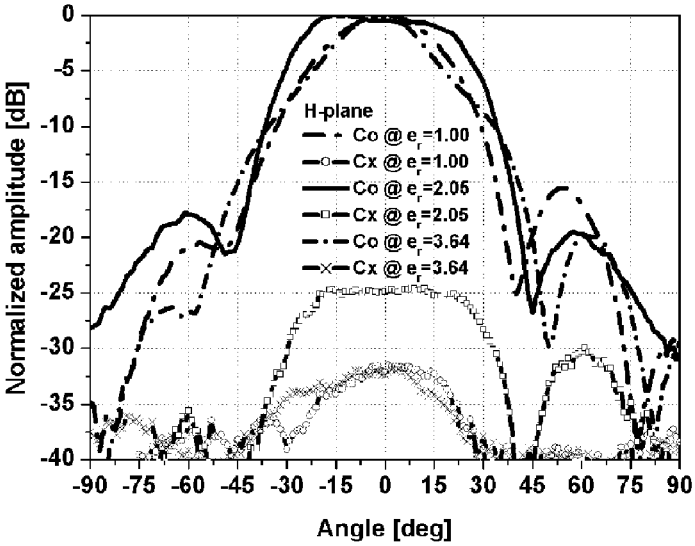
FIG. 11 is a graph illustrating an H-plane radiation pattern characteristic measured according to a change in dielectric constant of the shaped-beam antenna according to the embodiment of the present invention.

The flat-topped beam pattern characteristics measured according to a change in dielectric constant ($e_r$=1.00, 2.05, 3.64) of the dielectric ring are illustrated in FIGS. 10 and 11.

FIG. 10 is a graph illustrating an E-plane radiation pattern characteristic measured according to a change in dielectric constant of the shaped-beam antenna according to the embodiment of the present invention.

FIG. 11 is a graph illustrating an H-plane radiation pattern characteristic measured according to a change in dielectric constant of the shaped-beam antenna according to the embodiment of the present invention.

Referring to the measurement results, in case of the dielectric constant of 1.00 (no dielectric ring) or 3.64, the radiation pattern of the antenna corresponds to a high-gain characteristic. In case of the dielectric constant of 2.05, the radiation pattern of the antenna corresponds to the flat-topped beam pattern characteristic.

Accordingly, it can be understood that the dielectric constant of the dielectric ring surrounding the multi-layered metallic disk array of the shaped-beam antenna is a very important design-parameter for generating the flat-topped beam pattern.

Referring to FIGS. 10 and 11, the gain of the antenna without the dielectric ring is 13.61 dBi, whish is a high gain. However, the gain of the antenna having the flat-topped beam pattern characteristic ($e_r$=2.05) is 11.18 dBi. The decrease of about 2.43 dB in the gain of the antenna is because of the increase in the beam pattern width of the flat-topped beam with respect to a normal beam.

A cross polarization characteristic is obtained at the dielectric constant of 2.05. The cross polarization levels measured in the positive direction in E-plane and H-plane are 24.90 dB and 24.88 dB, respectively.

Figure 12:
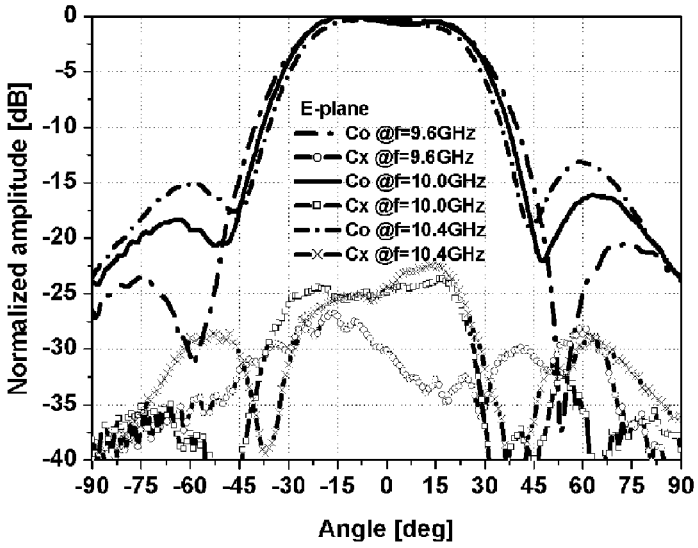
FIG. 12 is a graph illustrating an E-plane radiation pattern characteristic measured according to a change in frequency of a shaped-beam antenna according to an embodiment of the present invention.

FIG. 12 is a graph illustrating an E-plane radiation pattern characteristic measured according to a change in frequency of the shaped-beam antenna according to the embodiment of the present invention.

Figure 13:
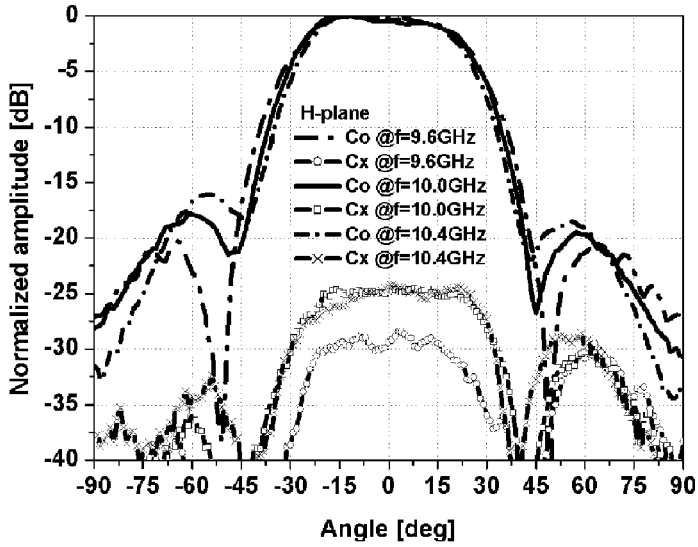
FIG. 13 is a graph illustrating an H-plane radiation pattern characteristic measured according to a change in frequency of the shaped-beam antenna according to an embodiment of the present invention.

FIG. 13 is a graph illustrating an H-plane radiation pattern characteristic measured according to a change in frequency of the shaped-beam antenna according to the embodiment of the present invention.

Referring to the flat-topped beam pattern characteristic measured according to a change in frequency, the cross polarization levels in the positive direction are more than 24.4 dB (@E-plan) and 24.38 dB (@E-plan) within a given frequency band, and more than 22.44 dB (@E-plan) and 24.33 dB (@E-plan) within the flat-topped beam pattern width of 40°. In addition, referring to the measurement results, it can be seen that a good flat-topped beam pattern characteristic can be obtained within a frequency bandwidth of about 8%.

Figure 14:
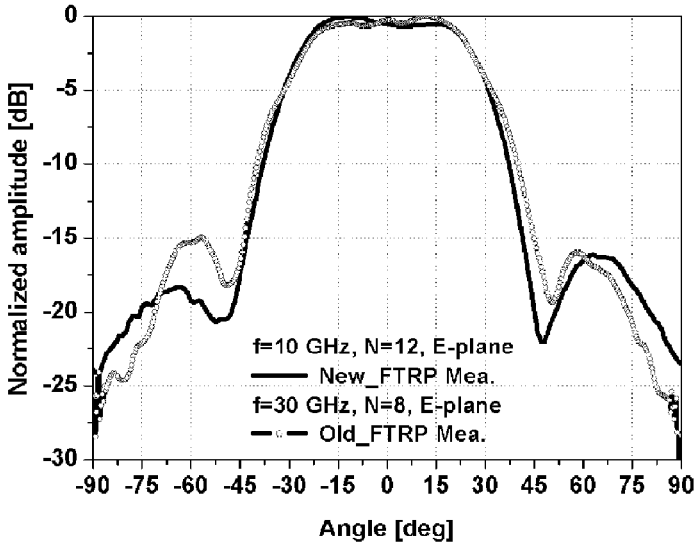
FIG. 14 is a graph for comparing an E-plane flat-topped beam pattern characteristic of a shaped-beam antenna according to an embodiment of the present invention with that of a conventional MDAS antenna.
Figure 15:
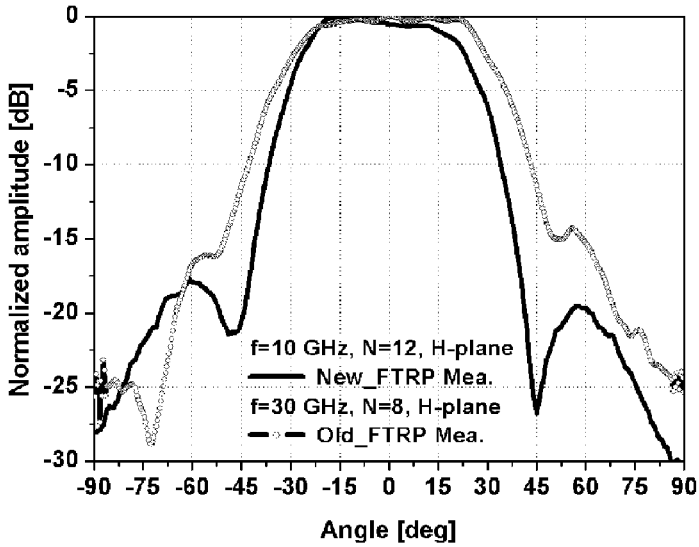
FIG. 15 is a graph for comparing an H-plane flat-topped beam pattern characteristic of the shaped-beam antenna according to the embodiment of the present invention with that of the conventional MDAS antenna.

Comparison results of the flat-topped beam pattern characteristic of the shaped-beam antenna according to the present invention and conventional antennas are illustrated in FIGS. 14 and 15.

FIG. 14 is a graph for comparing an E-plane flat-topped beam pattern characteristic of the shaped-beam antenna according to the embodiment of the present invention with that of a conventional MDAS antenna.

FIG. 15 is a graph for comparing an H-plane flat-topped beam pattern characteristic of the shaped-beam antenna according to the embodiment of the present invention with that of the conventional MDAS antenna.

In FIGS. 14 and 15, 'New FTRP Mea.' denotes measurement results of flat-topped radiation (beam) pattern (FTRP) of the sample of the shaped-beam antenna having 12 metallic disks designed at 10 GHz according to the present invention. 'Old FTRP Mea.' denotes measurement results of flat-topped radiation (beam) patterns of products of conventional MDAS antenna having 8 metallic disks designed at 30 GHz.

Referring to the comparison of the flat-topped beam patterns of FIGS. 14 and 15, it can be seen that the shaped-beam antenna forming a single flat-topped beam pattern has higher efficiency and better flat-topped beam pattern than the conventional antenna.

While the present invention has been particularly shown and described with reference to exemplary embodiments thereof, it will be understood by those skilled in the art that various changes in form and details may be made therein without departing from the spirit and scope of the invention as defined by the appended claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

The invention claimed is:

1. A shaped-beam antenna having a multi-layered conductive element array structure surrounded by a dielectric ring, comprising:

a planar excitation element having a radiation structure according to a required polarization;

a multi-layered conductive element array disposed on the planer excitation element, wherein the multi-layered conductive element array is formed by layering conductive elements at an arbitrary interval; and a dielectric ring surrounding the multi-layered conductive element array at a predetermined separation distance therefrom wherein the flat-topped beam pattern is generated by adjusting design parameters of the dielectric ring, wherein the design parameters of the dielectric ring include a dielectric constant, a radius, a height, and a thickness of the dielectric ring, and wherein a radius of the dielectric ring is between 1.4 and 1.6$\lambda_0$, and a height of the dielectric ring is between 1.0 and 1.4$\lambda_0$.

2. The shaped-beam antenna of claim 1, wherein the planar excitation element has a radiation structure including a microstrip patch structure or a dipole structure.

3. The shaped-beam antenna of claim 1, wherein the planar excitation element includes a stack microstrip patch element inserted into a cylindrical or hexagonal cavity.

4. The shaped-beam antenna of claim 3, wherein the stack microstrip patch element includes an active patch element and a passive patch element, wherein the active patch element is constructed by inserting a conductive member into an RF (radio frequency) substrate having an arbitrary diameter and an arbitrary thickness by using a thick-layer forming method, and wherein the passive patch element is constructed by using a thin conductive film or by coating a conductive member on a thin film.

5. The shaped-beam antenna of claim 4, wherein a dielectric foam layer having an arbitrary thickness is interposed between the active patch element and the passive patch element so as to maintain a predetermined distance between the active patch element and the passive patch element.

6. The shaped-beam antenna of claim 1, wherein in the multi-layered conductive element array, the conductive elements are layered at a regular or irregular interval in an upward direction separated by a predetermined separation distance from the planar excitation element.

7. The shaped-beam antenna of claim 6, wherein dielectric foam layers having a thickness corresponding to the regular or irregular interval are interposed between the conductive elements.

8. The shaped-beam antenna of claim 7, wherein a dielectric constant $\in_r$ of a dielectric material used for the dielectric foam is 1.05.

9. The shaped-beam antenna of claim 1, wherein the multi-layered conductive element array is constructed by layering conductive disks.

10. The shaped-beam antenna of claim 1, wherein the interval between the conducive elements and a size of each conductive element are equal to or smaller than a non-resonance structure characteristic value of 0.5$\lambda_0$.

11. The shaped-beam antenna of claim 1, wherein the conductive elements have a diameter of 0.3$\lambda_0$, the conductive elements comprise twelve layers, and a distance between the layers is 0.1$\lambda_0$.

12. An antenna, comprising:

a multi-layered conductive element array structure having layered conductive elements; and a dielectric ring surrounding the multi-layered conductive element array at a predetermined separation distance therefrom to generate a flat-topped beam pattern, wherein the flat-topped beam pattern is generated by adjusting design parameters of the dielectric ring, wherein the design parameter of the dielectric ring include a dielectric constant, a radius, a height and a thickness of the dielectric ring, and wherein a radius of the dielectric ring is between 1.4 and $1.6\lambda_0$ and a height of the dielectric ring is between 1.0 and $1.4\lambda_0$.

13. A shaped-beam antenna having a multi-layered conductive element array structure surrounded by a dielectric ring, comprising:

a planar excitation element having a radiation structure according to a required polarization;

a multi-layered conductive element array disposed on the planer excitation element, wherein the multi-layered conductive element array is formed by layering conductive elements at an arbitrary interval; and a dielectric ring surrounding the multi-layered conductive element array at a predetermined separation distance therefrom, wherein a radius of the dielectric ring is between 1.4 and $1.6\lambda_0$, and a height of the dielectric ring is between 1.0 and $1.4\lambda_0$, and wherein the planar excitation element includes a stack microstrip patch element inserted into a cylindrical or hexagonal cavity.

14. The shaped-beam antenna of claim 13, wherein the stack microstrip patch element includes an active patch element and a passive patch element, wherein the active patch element is constructed by inserting a conductive member into an RF (radio frequency) substrate having an arbitrary diameter and an arbitrary thickness by using a thick-layer forming method, and wherein the passive patch element is constructed by using a thin conductive film or by coating a conductive member on a thin film.

15. The shaped-beam antenna of claim 14, wherein a dielectric foam layer having an arbitrary thickness is interposed between the active patch element and the passive patch element so as to maintain a predetermined distance between the active patch element and the passive patch element.

16. The shaped-beam antenna of claim 13, wherein in the multi-layered conductive element array, the conductive elements are layered at a regular or irregular interval in an upward direction separated by a predetermined separation distance from the planar excitation element.

17. The shaped-beam antenna of claim 16, wherein dielectric foam layers having a thickness corresponding to the regular or irregular interval are interposed between the conductive elements.

* * * * *